US006543343B2

(12) United States Patent
Taylor

(10) Patent No.: US 6,543,343 B2
(45) Date of Patent: Apr. 8, 2003

(54) TRANSPORTABLE RECYCLABLE MATERIALS DENSIFIER

(76) Inventor: William S. Taylor, 1142 Ivy Hill, Harlan, KY (US) 40831

( * ) Notice: Subject to any disclaimer, the term of this patent is extended or adjusted under 35 U.S.C. 154(b) by 22 days.

(21) Appl. No.: 09/775,260

(22) Filed: Feb. 1, 2001

(65) Prior Publication Data

US 2002/0100377 A1 Aug. 1, 2002

(51) Int. Cl.[7] ..... B30B 15/00; B30B 15/30; B30B 15/32

(52) U.S. Cl. ..... 100/100; 100/215; 100/218; 100/226

(58) Field of Search ..... 100/215, 218, 100/240, 245, 94, 95; 209/38, 225, 226, 223.1

(56) References Cited

U.S. PATENT DOCUMENTS

| | | | | | |
|---|---|---|---|---|---|
| 3,597,927 | A | * | 8/1971 | Hemphill | 37/189 |
| 4,059,050 | A | * | 11/1977 | Davis, Jr. | 100/173 |
| 4,084,496 | A | * | 4/1978 | Ehernberger et al. | 100/100 |
| 4,417,510 | A | * | 11/1983 | Sharp | 100/218 |
| 4,541,332 | A | * | 9/1985 | Horansky et al. | 100/215 |
| 4,669,375 | A | * | 6/1987 | Newsom et al. | 100/215 |
| 4,787,308 | A | * | 11/1988 | Newsom et al. | 100/215 |
| 4,967,912 | A | * | 11/1990 | Schonberg | 100/902 |
| 5,040,937 | A | * | 8/1991 | Godbersen | 280/414.1 |
| 5,195,429 | A | | 3/1993 | Firpo | |
| 5,203,261 | A | | 4/1993 | Davis | |
| 5,336,036 | A | * | 8/1994 | Williamson et al. | 100/215 |
| 5,624,018 | A | | 4/1997 | Schuff et al. | |
| 5,671,666 | A | | 9/1997 | Wenglar | |
| 5,713,269 | A | | 2/1998 | Maurer | |
| 6,050,181 | A | | 4/2000 | Zenk | |

* cited by examiner

*Primary Examiner*—Allen Ostrager
*Assistant Examiner*—Jimmy T Nguyen
(74) *Attorney, Agent, or Firm*—Pitts & Brittian P.C.

(57) ABSTRACT

A transportable recyclable materials densifier including an integrally configured conveyor, separator, and compactor chamber mounted on a trailer frame that is transportable along public and private roads, for separation of ferrous from non-ferrous materials, and for compaction of non-ferrous materials at each location to which the trailer is transported. A conveyor is directs materials to the separator for separation of non-ferrous materials that are directed into an upper opening in a first end of the compactor chamber, with rejection of ferrous materials from the separator for discharge. A reciprocally extendable piston and compactor end extends through the compactor chamber to compact the materials into a second end of the chamber. The compacted materials form a densified shape against a movable end wall that is raised after compaction for ejection of each densified shape from the compaction chamber for storage and/or transport to a recycling operation.

20 Claims, 9 Drawing Sheets

TRANSPORTABLE RECYCLABLE MATERIALS DENSIFIER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

1. Field of Invention

The present invention relates to an apparatus for reducing the volume of recyclable materials. More specifically, the present invention relates to a transportable apparatus for separating recyclable aluminum materials from metallic materials and reducing the volume of the separated aluminum materials.

2. Description of the Related Art

There continues a need to reduce the size and volume of empty metal cans for ease of handling, along with a need to transport a compactor over public roads for deliver to a plurality of locations for size reduction of recyclable materials. Also, a preference exists for separation of aluminum cans from steel containers before reducing the size of each type of container into a dense volume. Stationary apparatus for separating and crushing containers are well known. The prior apparatus typically include a moving conveyor to transport cans to a crusher or flattening mechanism, with the crushed or flattened cans moved into a storage unit for transport to a recycling operation.

Prior compactors include one piston or multiple pistons in compacting or flattening mechanisms that are operated to crush one recyclable item at a time. Alternatively, a pre-compaction step is utilized by prior compactors to flatten or crush multiple recyclable articles prior to additional compaction with a piston in a two-step process. Typically, the prior compactors do not provide an integral compaction unit having wheel assemblies and towing equipment for transport at elevated speeds over public and private roads to deliver the apparatus to a multitude of locations where recyclable materials are stored.

A need exists for a compactor apparatus that provides for separation of ferrous materials from non-ferrous materials, and for densification of recyclable non-ferrous containers, bulky materials, and/or elongated materials in an integrally configured transportable unit that provides ease of operation and transportation over public and private roads as a trailer towed to multitude locations for separation and size reduction of recyclable materials.

Therefore, it is an object of the present invention to provide a transportable apparatus for separating recyclable ferrous materials from non-ferrous materials.

It is a further object of the present invention to provide a transportable apparatus for compacting recyclable materials having elongated lengths and/or having multiple sized container shapes.

It is a further object of the present invention to provide a towable transport trailer having integrally configured separator and compactor of recyclable materials for compacting non-homogeneous shapes of recyclable materials.

It is a further object of the present invention to provide a towable vehicle for separating ferrous from non-ferrous materials, and for generating a densified shape of non-ferrous materials with an integrally configured and hydraulicly controlled compactor unit that is transportable along public and private roads.

BRIEF SUMMARY OF THE INVENTION

Other objects and advantages of the present invention will become more apparent upon reviewing the detailed description and associated figures of an integrally configured conveyor, separator and compactor chamber mounted on a trailer including a frame having a hitch connector and a plurality of wheels rotatably mounted to the frame for transport of the trailer along public and private roads by a transport vehicle. The frame includes a conveyor system for delivery of ferrous and non-ferrous materials to a separator. The separator directs the non-ferrous materials into a channel leading to a compactor chamber, with ferrous materials retained on the separator by magnetic attraction until redirected for discharge from the conveyor system. The non-ferrous materials are received through an upper opening proximate a first end of the compactor chamber for compaction of the materials by a piston having a compactor end that is reciprocally extendable through the compactor chamber. The compacted material is compressed into a second end of the chamber by the reciprocally extendable piston and compactor end. A self-supporting densified shape is formed against a movable end wall in the second end of the compactor chamber after repetitive compaction of additional non-ferrous materials directed into the second end of the chamber by the piston and compactor end. The self-supporting densified shape is released from the compactor chamber by raising the end wall, to allow the densified shape to be pushed out of the second end of the compactor chamber by an extended piston and compactor end. Each self-supporting densified shape is retained outside of the compactor chamber by extension under a retention flap pivotably attached on the exterior of the second end of the compactor chamber, allowing for storage and/or transport of each densified shape to a recycling operation.

BRIEF DESCRIPTION OF THE SEVERAL VIEWS OF THE DRAWINGS

The above-mentioned features of the invention are more clearly understood from the following detailed description of the invention read together with the drawings in which.

DETAILED DESCRIPTION OF THE INVENTION

Figure 1:
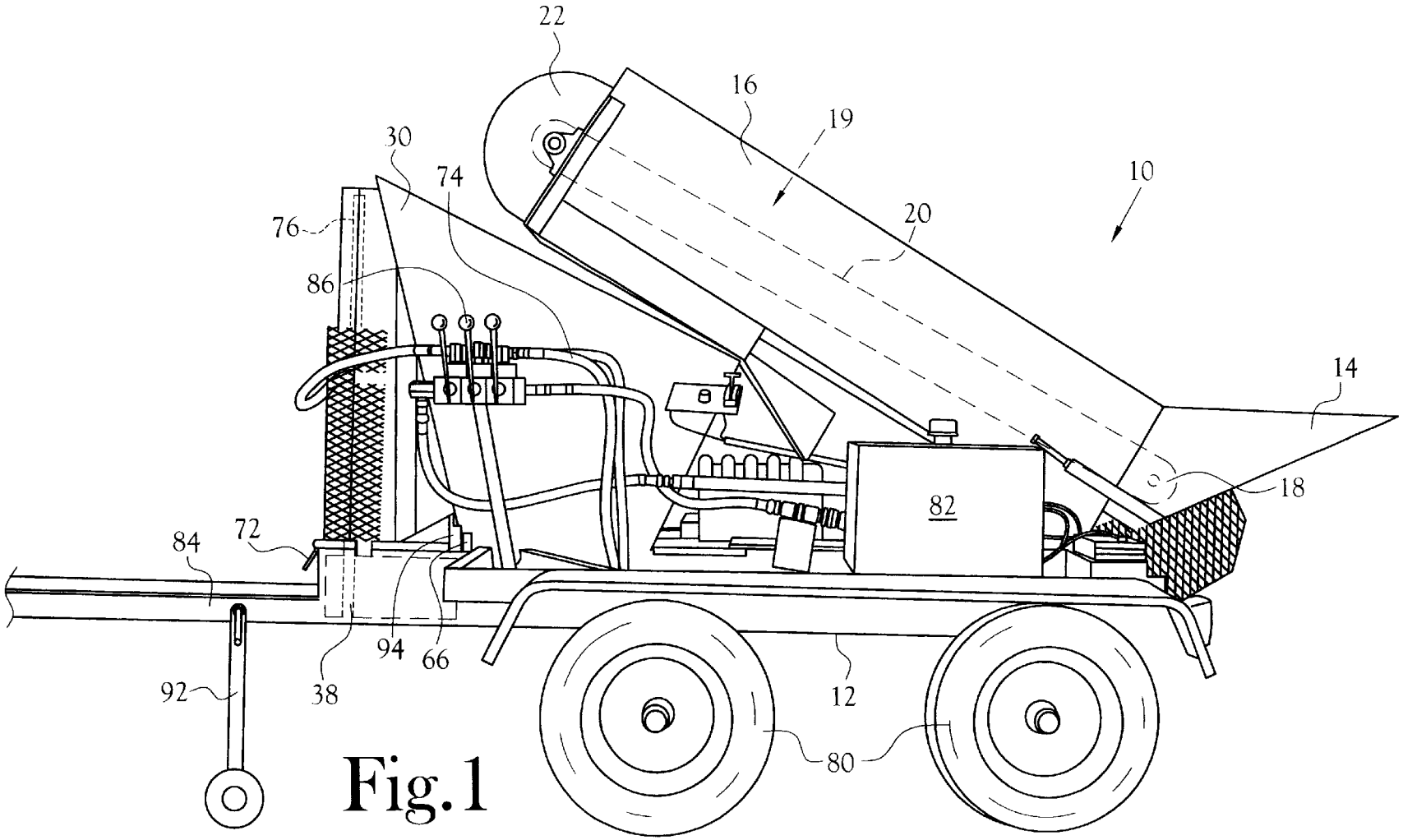
FIG. 1 is a perspective side view of a transportable compactor of the present invention, illustrating a frame having transport wheels, a hydraulic control system, and a conveyor system integrally mounted thereon.
Figure 2:
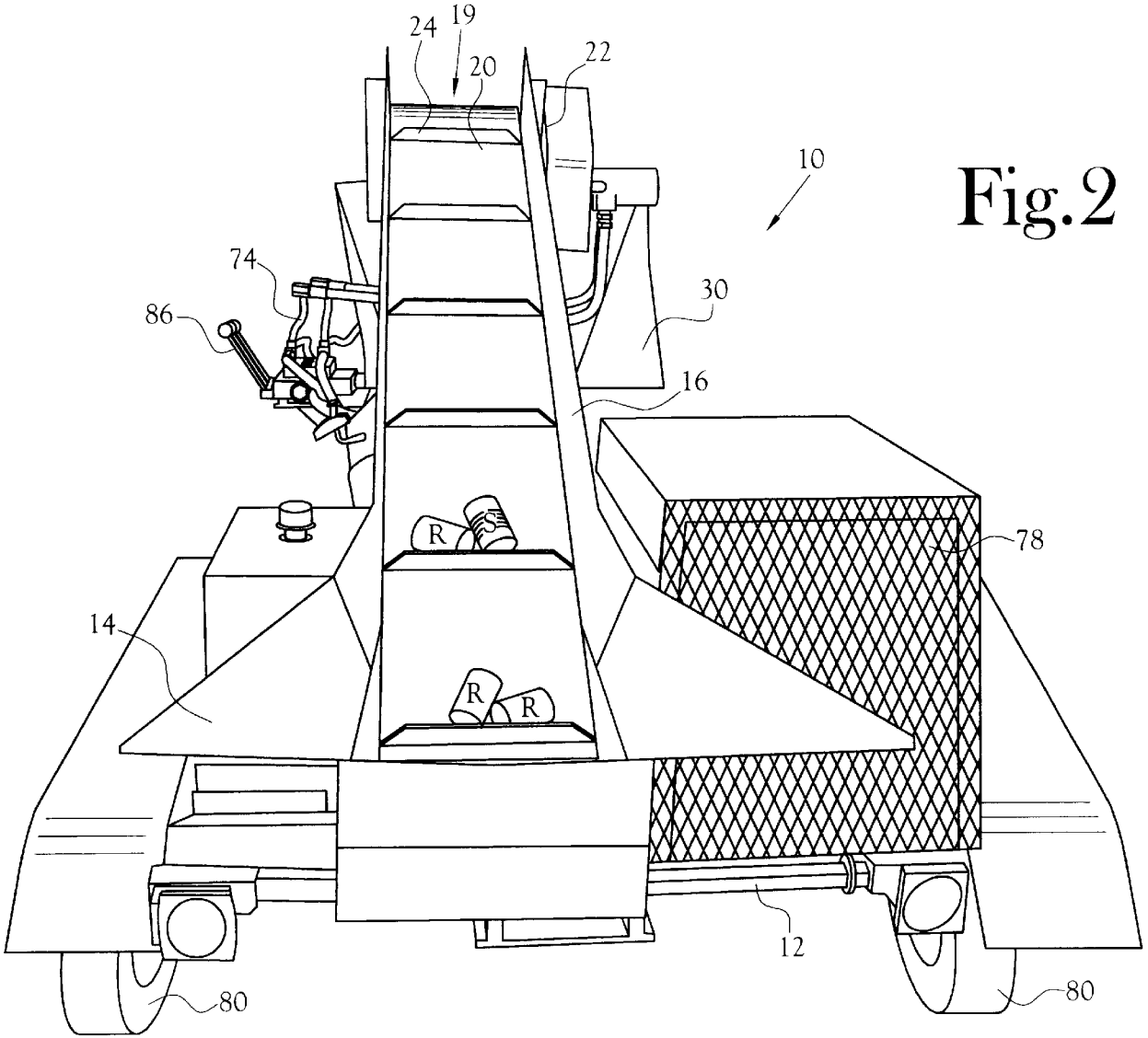
FIG. 2 is an rear perspective view of FIG. 1, illustrating the receiving end of the transportable compactor of the present invention.

A transportable compactor apparatus of the present invention for separating and compacting of recyclable materials is illustrated generally at 10 in FIGS. 1 and 2. The transportable compactor 10 includes a frame 12 providing a trailer platform for integrally securing thereon a plurality of conveyor, separator, and compactor equipment. The frame 12 includes a support carriage having at least two pair of wheels 80 designed to support and be rotatable to provide mobility for the transportable compactor 10 by connection to a transport vehicle for transport along public and private roads to a multitude of locations for separating and compacting of collected recyclable materials.

On a first end of the frame 12 is mounted a receiving hopper 14, into which materials having potential recycle value are placed, such as cans and various sized containers of ferrous materials S and non-ferrous materials R such as aluminum. The receiving hopper 14 channels recyclable materials S, R onto a conveyor 19 that is integrally supported by the frame 12. The conveyor 19 includes a continuous conveyor belt 20 that conveys the recyclable materials from the receiving hopper 14 of conveyor chute 16, to an elevated discharge end of the conveyor belt 20 that is proximate an upper rotatable drive cylinder 22 positioned proximate a middle portion of the frame 12 (see FIGS. 1 and 2).

The conveyor belt 20 is moved by a conveyor mechanism known to those skilled in the art, by rotation of the belt 20 around the lower rotatable slave cylinder 18 (see FIG. 1) positioned at the first end of the frame 12, and the receiving end of the conveyor chute 16. The conveyor belt 20 extends to and rotates around an upper rotatable drive cylinder 22 positioned at the elevated discharge end of the conveyor belt 20 (see FIGS. 1 and 2). The movable conveyor belt 20 includes a plurality of spaced apart ridges 24 attached on the conveyor belt 20, that collect limited amounts of the recyclable materials that are placed in the receiving hopper 14, for conveyance by the movable belt 20 to the elevated discharge end at the upper rotatable drive cylinder 22 and proximate a gathering hopper 30. The spaced apart ridges 24 on the movable conveyor belt 20, after discharge of recyclable materials from each ridge 24 proximate the elevated discharge end, are continuously rotated along with the conveyor belt 20 under the upper cylinder 22, and along the lower portion of the conveyor chute 16 for return to the lower cylinder 18 at the first end of the frame 12 and the receiving end of the conveyor chute 16 for further conveyance of recyclable materials to the upper drive cylinder 22 for separation into gathering hopper 30.

Figure 3A:
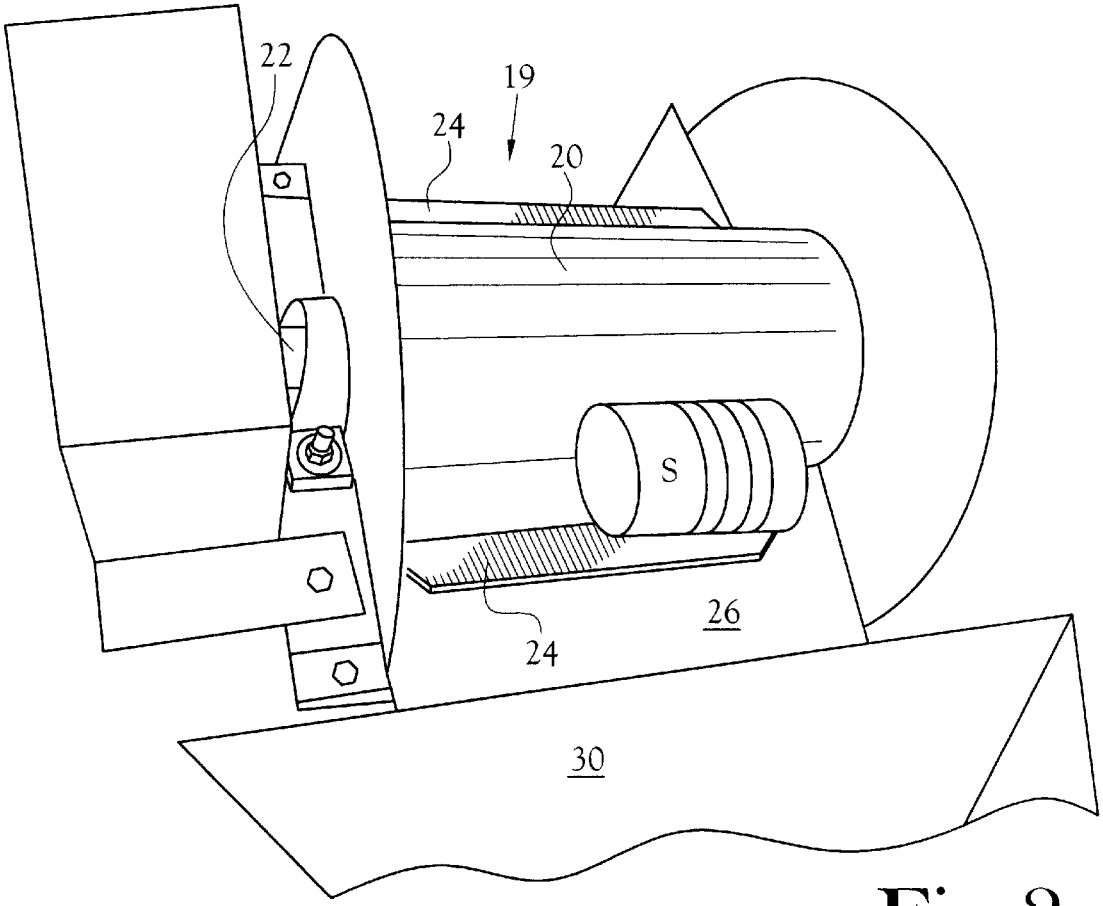
FIG. 3*a* is a rear perspective view of FIG. 2, illustrating the discharge end of the movable conveyor belt having a ferrous can retained for separation from the non-ferrous materials.
Figure 3B:
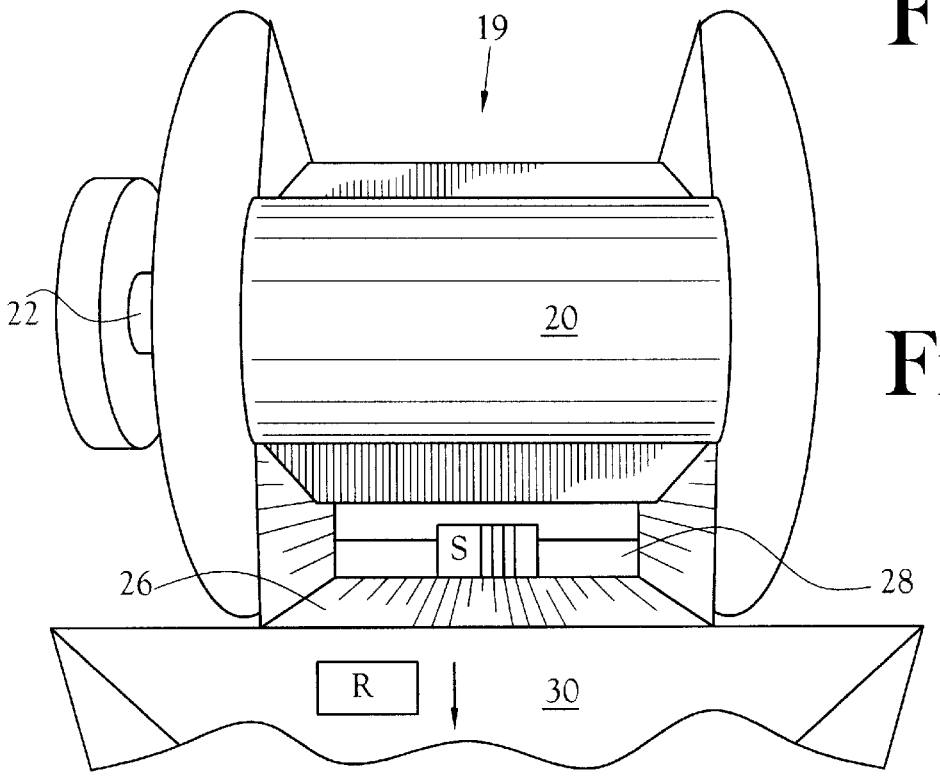
FIG. 3*b* is a rear view of FIG. 3*a*, illustrating the reject chute and redirecting bar for separation of ferrous cans from non-ferrous materials.
Figure 4:
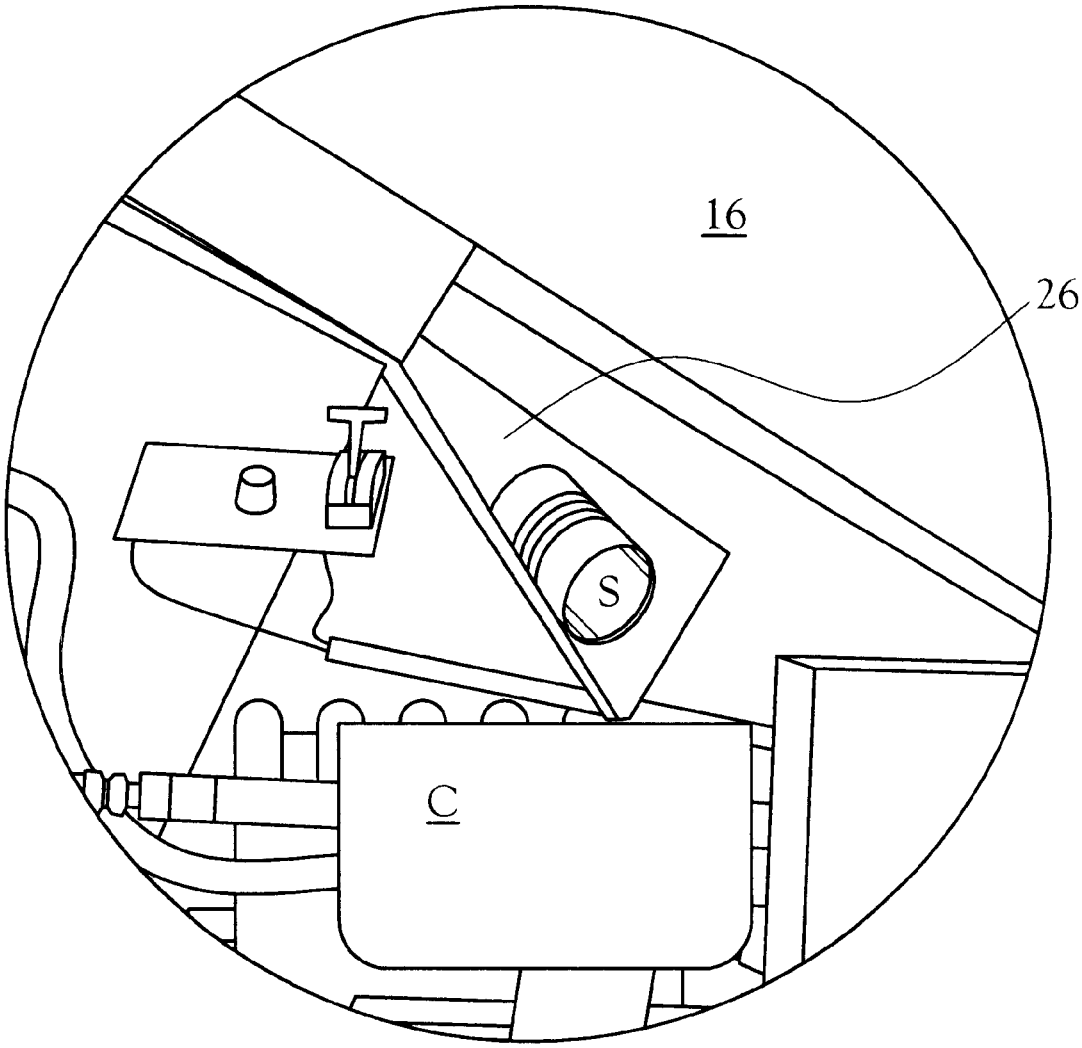
FIG. 4 is a side perspective view of the discharge end of the discharge chute for ferrous cans.
Figure 5A:
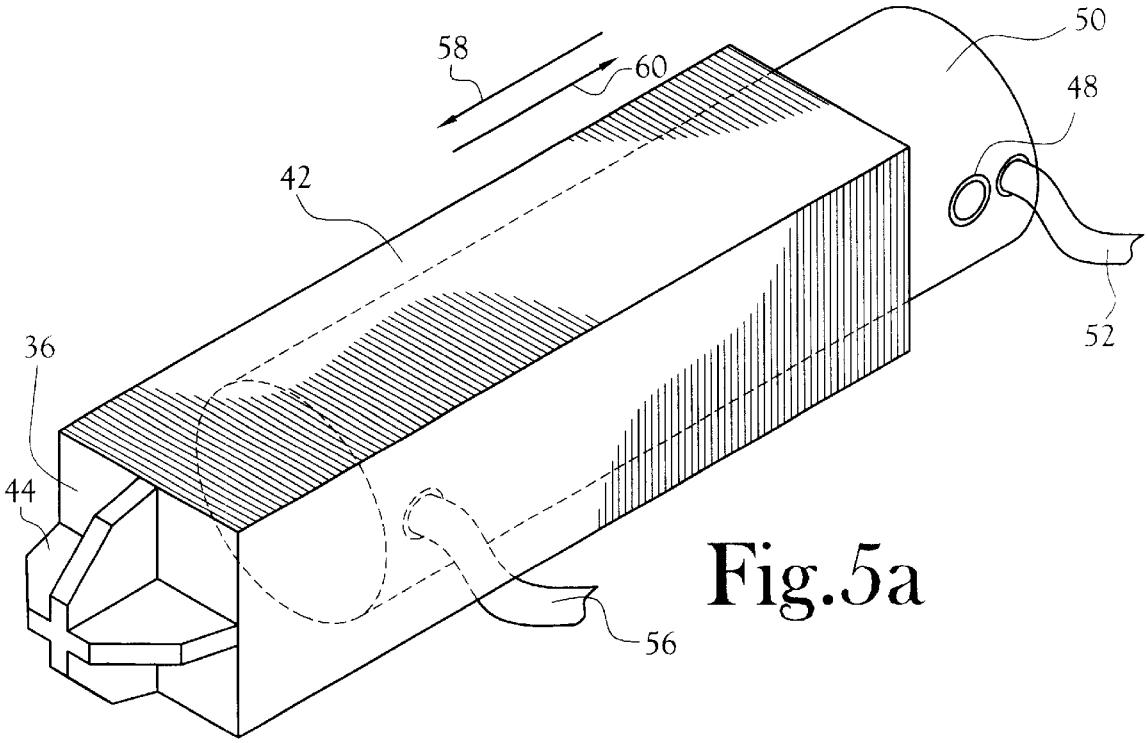
FIG. 5*a* is a perspective view of the piston compactor end and hydraulic cylinder of the present invention.
Figure 5B:
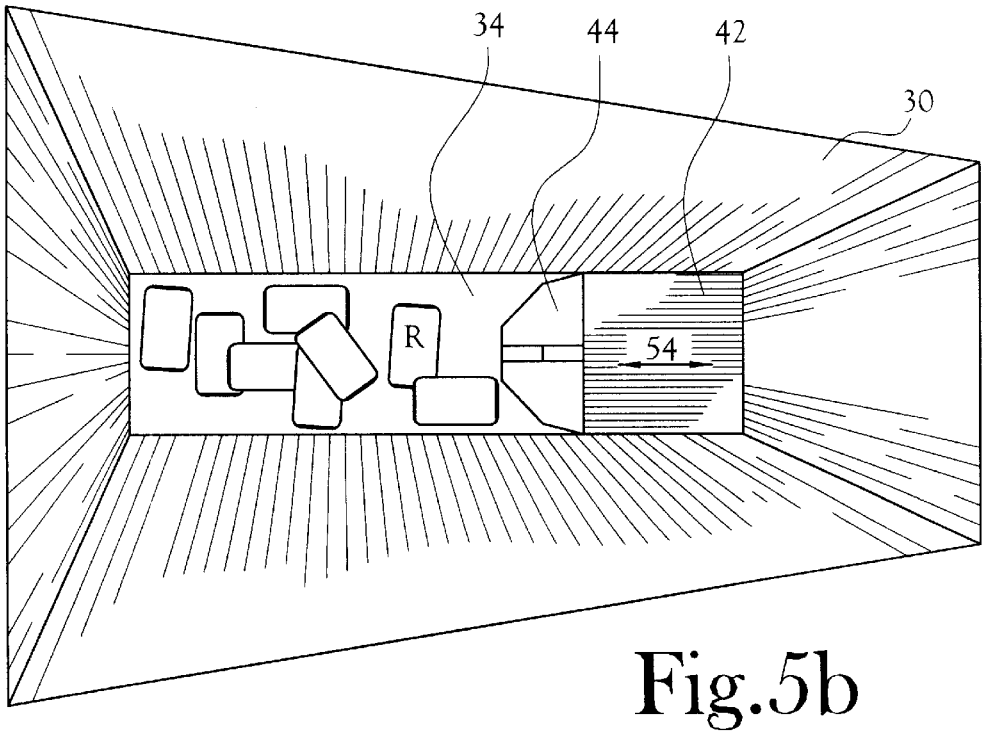
FIG. 5*b* is a top view into an upper opening of a compactor chamber of the present invention.
Figure 8:
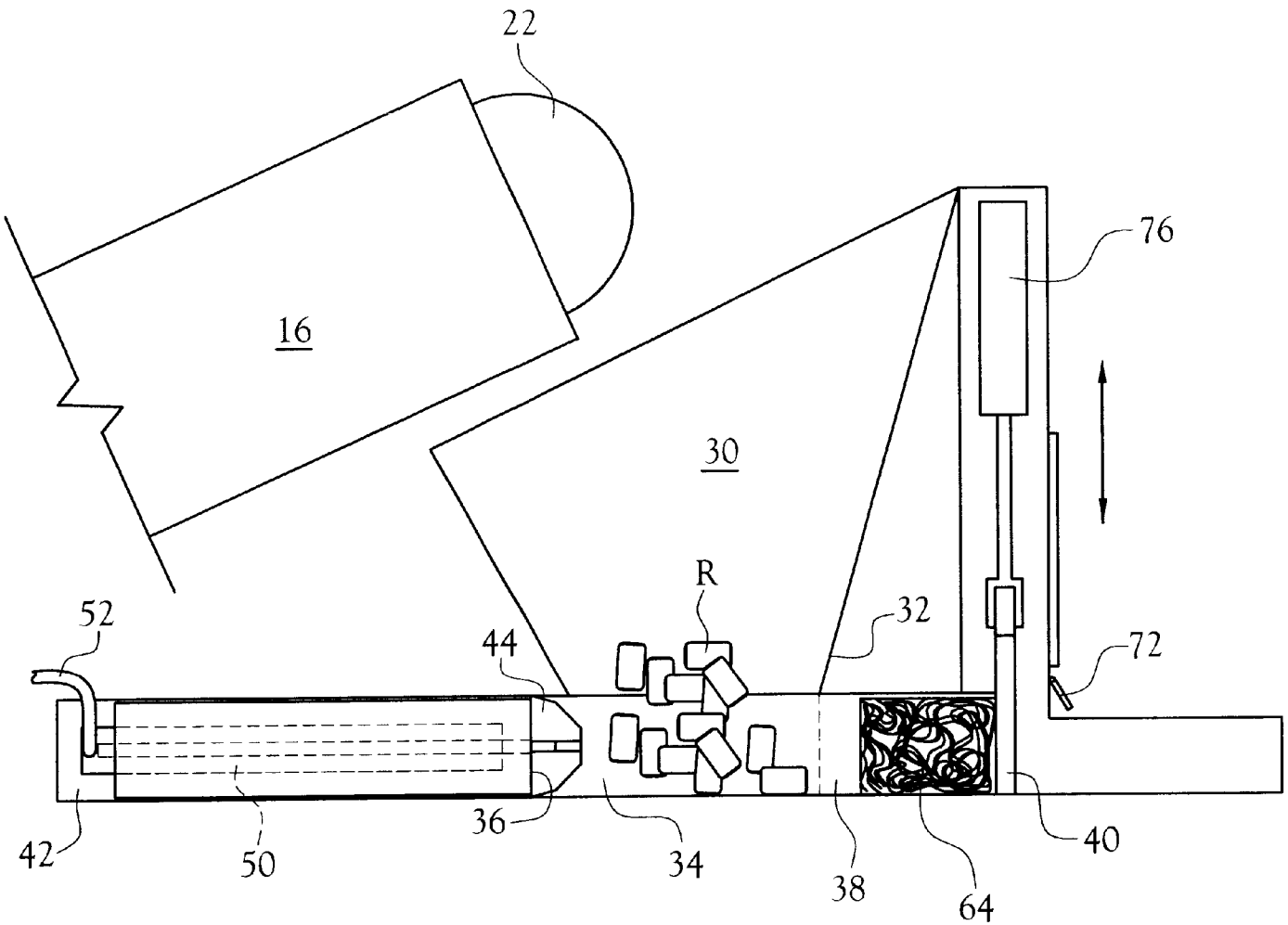
FIG. 8 is a schematic view of the compactor chambers of FIG. 7, illustrating the first and second ends of the compactor chamber of the present invention.

At the elevated discharge end, a materials separator unit is mounted above the frame 12 and proximate the upper drive cylinder 22, with the non-ferrous materials and containers R such as aluminum or other non-ferrous cans are discharged into the gathering hopper 30, for conveyance by the feed funnel 32 into an upper opening (see FIG. 5*b*) in a compactor chamber 34 that is mounted under the feed funnel 32 (see FIG. 8). The materials separator unit at the elevated discharge end includes a magnetized field maintained along the upper cylinder 22 around which the belt 20 is rotated. Due to magnetic attraction, the ferrous containing containers such as steel containers S are retained on the conveyor belt 20 as the it rotates under the upper cylinder 22. Non-ferrous materials and containers R fall from the upper cylinder 22 and into the gathering hopper 30. Therefore the ferrous containers S are separated from the non-ferrous containers R during rotation of the upper cylinder 22. As each ferrous container S is retained on the movable belt 20 as it rotates under the upper cylinder 22 (see FIG. 3*a*), the ferrous container S is contacted against a separator bar 28 (see FIG. 3*b*) for redirection of each ferrous container S down through a chute 26 for delivery of each ferrous container S to a collection bag or container C that is removably attachable to a lower end of the chute 26 for storage of ferrous containers (see FIG. 4).

After separation and redirection of ferrous containing containers S at the discharge end of the upper cylinder 22, aluminum or non-ferrous materials R are dropped by gravity through the gathering hopper 30 and are channeled by the feed funnel 32 (see FIG. 8) into the upper opening proximate the first end portion of compactor chamber 34. As a volume of aluminum or non-ferrous materials R is collected in the first end of compactor chamber 34, the compactor end of piston 42 having a protruding ram head 44 (see FIG. 5*a*) is advanced along the lengthwise axis 54 (see FIG. 5*b* ), and through the first end of compactor chamber 34 (see FIG. 5*b*), for crushing and compacting of materials into the bailing chamber 38 which forms a second end of compactor chamber 34.

The first end of compactor chamber 34 is shaped in a generally rectangular shape along the lengthwise axis 54, and includes a length, width and height that is selected during the assembly of the compactor chamber 34 and other integral units of the transportable compactor 10, to determine the volume of the compactor chamber 34, which therefore allow a volume of aluminum or non-ferrous materials R to be received, crushed, and compacted in the compactor chamber 34 and the bailing chamber 38. The raised ram head 44 on the piston end of the piston 42 is moved through the compactor chamber 34 to apply compaction pressure up to about thirty tons of applied pressure when the piston end 36 is moved against the volume of recyclable materials within compactor chamber 34 (see FIG. 5*b*). The piston end 36 and the ram head 44 traverse the lengthwise axis 54 to a transition underneath the leading wall of feed funnel 32 (see FIG. 8), into an aligned second end of the chamber, known in the art as a bailing chamber 38 (see FIG. 8). The bailing chamber 38 is sized at about eight inches in width, by about eight inches in height, by about eight to about twelve inches in length.

The bailing chamber 38 includes a movable end wall that is formed by a keeper gate 40 in a lowered position, against which recyclable materials are compressed during repetitive steps of compacting (see FIG. 8). The lowered keeper gate 40 (see FIG. 6*a*) functions as an end wall and movable gate which is lifted vertically to a raised position 70 (see FIG. 6*b*) by a hydraulicly actuated piston 76 connected to a top portion of the keeper gate 40 to allow ejection of a densified shape 68 of recyclable materials out of the bailing chamber 38. The repetitive compacting action of the ram head 44 against the compressed materials forced against end wall 40, provides compacting of large volumes of recyclable materials such as aluminum cans by the ram head 44 into a plurality of densified cubes 68 of recyclable materials that are ejected form the bailing chamber 38 and are temporarily stored in the trough 84, or transported to a recycling operation.

The bailing chamber 38 includes four enclosing side walls and a second end opening covered by a movable end wall formed by a vertically movable keeper gate 40. The movable keeper gate 40 remains in a closed configuration (see FIG. 6*a*), until an operator engages a hydraulic lift mechanism to vertically reposition the keeper gate 40 into a raised position 70 (see FIG. 6*b*), thereby opening the second end opening for passage of a compacted mass or a densified shape of recyclable materials. Proximate the exterior side of the movable keeper gate 40 and the exterior of the second end of the compactor chamber 34 is positioned a pivotable retention flap 72 that is connectable to the outer portion of the exterior side walls (see FIG. 6*a* and 6*b*) of the bailing chamber 38 by a pivot means known to those skilled in the art. The pivot means allows the retention flap 72 to pivot upwards (see FIG. 6*b*) as a densified shape 68 is pushed through the second end opening formed when keeper gate 40 is moved to a raised position 70, for exit of the densified shape 68 from the bailing chamber 38 into a trough 84 for temporary storage. The retention flap 72 pivots downward due to gravity for positioning onto a partially extended densified shape 68 to retain the densified shape 68 from moving back into the bailing chamber 38 when the piston 42 and ram head 44 is retracted into the first end of the compactor chamber 34, thereby retaining each densified shape 68 on the exterior of the second end when keeper gate 40 is lowered to a closed configuration for additional compaction against the closed keeper gate 40.

The piston 42 includes a hydraulically actuated cylinder 50 that operates in concert with the piston 42 for reciprocal extension of a compactor end having the ram head 44 through the first end of the compactor chamber 34 and toward the bailing chamber 38. The reciprocally extendable ram head 44 includes a raised, protruding pattern on the compactor end surface of the ram head 44. The raised pattern includes a star shape having edges sloped toward the ram end surface. The star shaped pattern assists with interlocking the compacted materials such as cans together in a densified shape 68 that minimizes the separation of the compacted cans from the densified shape 68 during storage and/or transport without the need for binding or wrapping of the densified shape 68. The densified shape 68 is formed into shapes such as a cube of about eight inches by about eight inches by about eight inches in size, or a rectangular shape having a weight of about eight to about ten pounds, The piston 42 and ram head 44 are joined at piston end 36 to form a piston 42 that is reciprocally extendable by a hydraulic system including pressurized hydraulic fluid transferred through hoses 52, 56 to create reciprocal movement 58, 60 of the piston 42 and ram head 44 in relation to a cylinder 50 that is positioned interior of the piston 42 (see FIG. 5*a*). The piston 42 includes openings in a lower surface, and/or the origination end opposed from the piston end 36, to allow insertion of hydraulic fluid hoses 52, 56 for connection to cylinder 50.

The origination end of the cylinder 50 includes a connecting pin 48 that anchors the origination end of the cylinder 50 to the supporting frame 12. Detachment of connecting pin 48 allows removal of the piston 42, ram head 44 and cylinder 50 as a cylinder assembly unit for maintenance. At the origination end of the cylinder 50, is located a hydraulic hose 52 attached to the cylinder 50 for pressurized flow of hydraulic fluid into the cylinder 50, for forward movement 58 of the piston 42 into the first compactor chamber 34. In one embodiment, the cylinder 50 is positioned within the piston 42, with the piston 42 being reciprocally extended horizontally in relation to the cylinder 50 due to pressure differentials generated between hydraulic liquids pumped into the compactor end, or pumped into the origination end of the cylinder 50 through hydraulic hoses 52, 56, as known to those skilled in the art of hydraulicly operated machines. The piston 42 and cylinder 50 are operated by pressurized hydraulic fluid supplied by a plurality of hydraulic hoses 52, 56 and 74, with hydraulic fluid pressures of up to about thirty tons of pressure provided by an engine 78 of about eighteen horsepower, supplied with fuel from a fuel tank 88, and each engine and fuel tank integrally mounted on the frame 12. Control of the hydraulic system is by an operator manipulating controls 86 that are located proximate a side of the gathering hopper 30 and the first end of the compactor chamber 34. The hydraulic fluids are supplied from a hydraulic reservoir 82 connected to the cylinder 50 by hoses 52, 56, with one embodiment of operation providing fluid pumped through hose 52 to force the piston 42 horizontally forward 58 into the first end of the compactor chamber 34, and with fluid periodically pumped through hose 56 for horizontal movement back 60 toward to an original, non-compacting position. The piston 42 is reciprocally extendable in a plurality of extension and return cycles to progressively extend to a full length (not shown) through the first end of the compactor chamber 34 and partially through the second bailing chamber 38 for compactor of cans and recyclable materials into a partially compacted mass 64 within the second bailing chamber 38 and against keeper gate 40 when in a closed configuration.

Figure 6A:
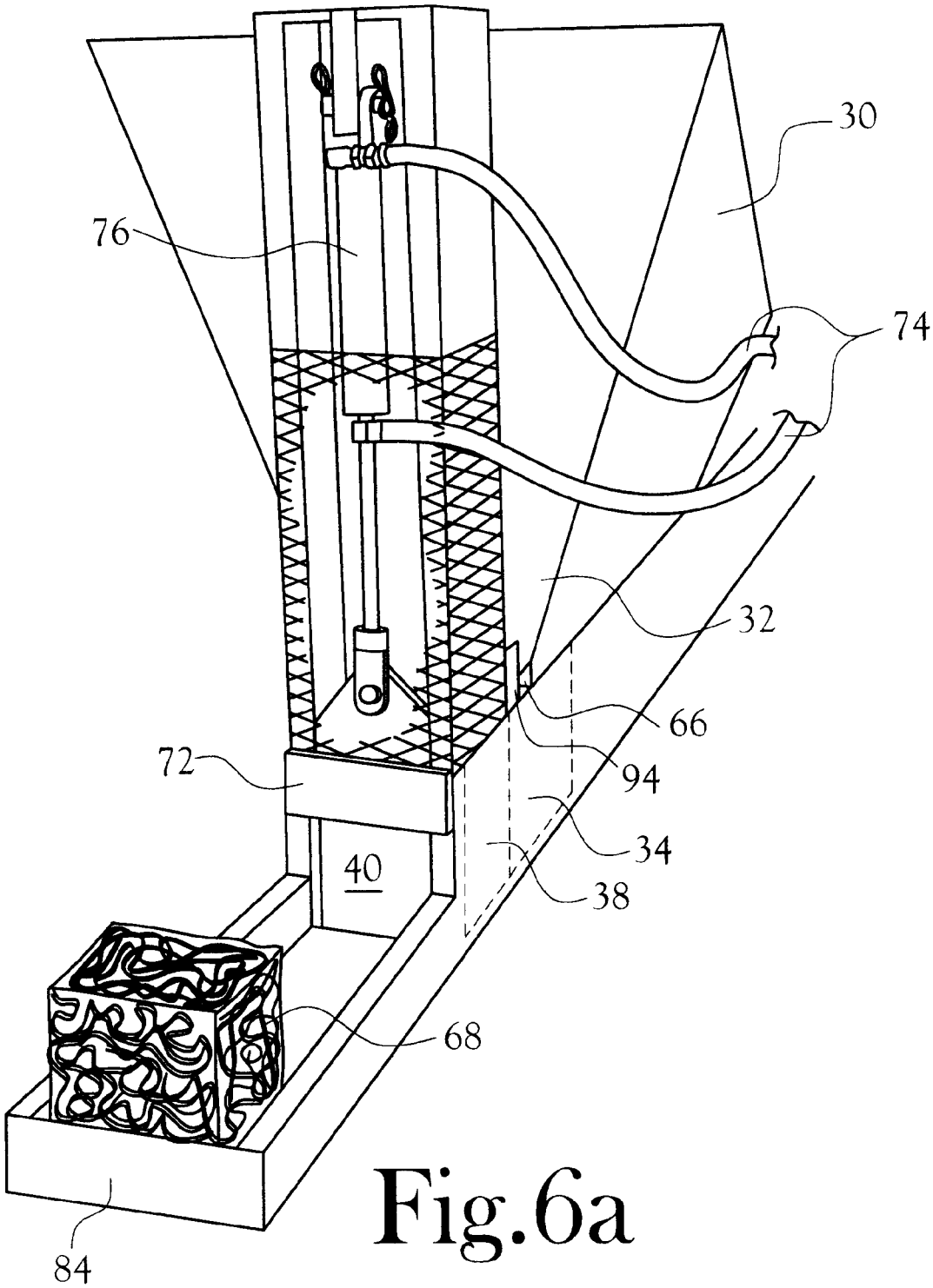
FIG. 6*a* is a rear perspective view of a hydraulic lift mechanism connected to a movable end wall positioned in a closed configuration, with a densified shape ejected from a compactor chamber.
Figure 6B:
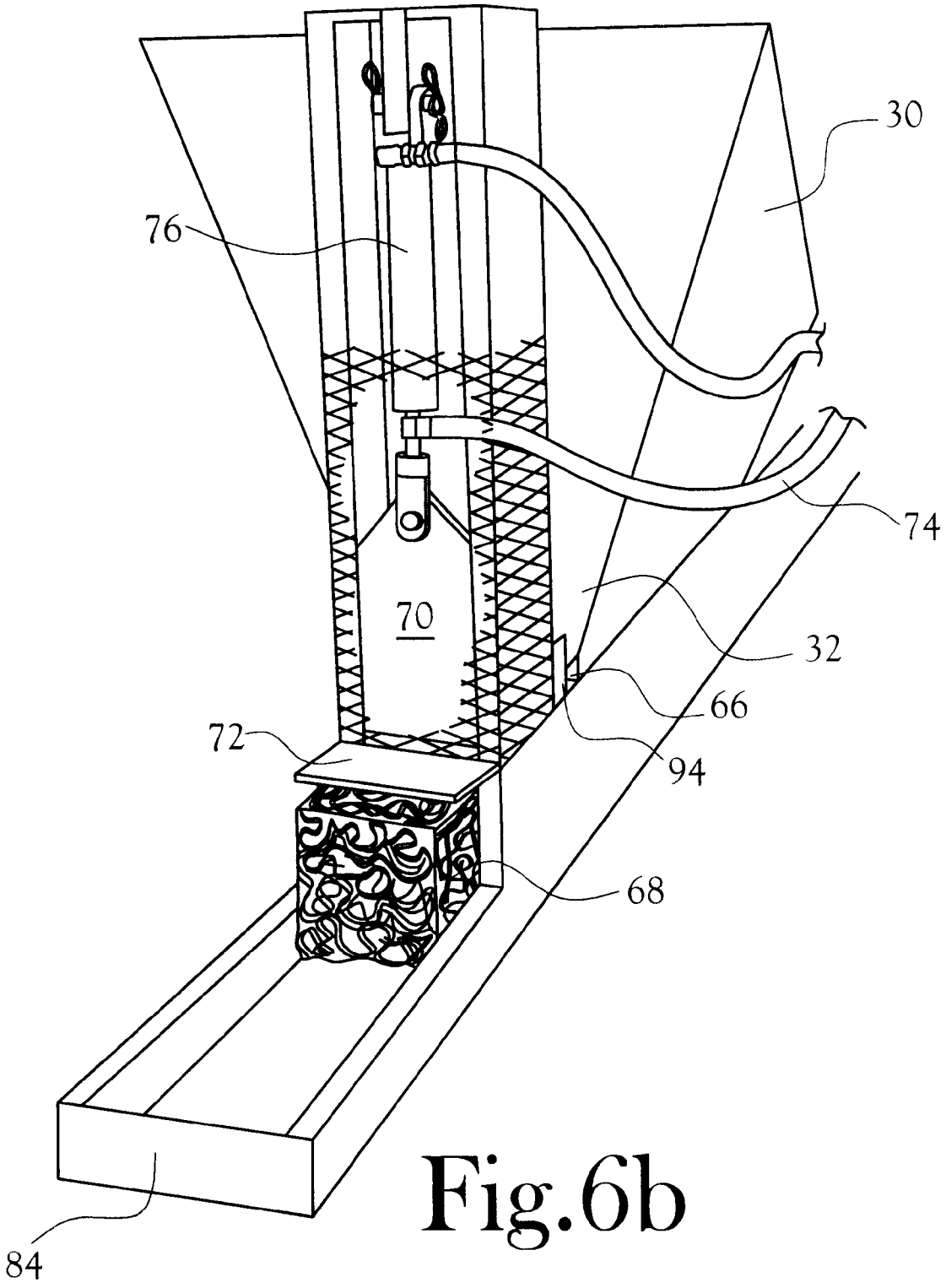
FIG. 6*b* is a rear perspective view of the movable end wall raised by the hydraulic lift mechanism, with a densified shape retained by a retention flap operated independent from the hydraulic lift mechanism.

At the base of the feed funnel 32 is located a shear opening 66 in one side wall of the feed funnel 32 at about the level of the junction of a lower portion of the feed funnel 32 with the interior upper opening in the compactor chamber 34 (see FIG. 1, 6*a* and 6*b*). The shear opening 66 is about two inches by about two inches. A shear bar 94 is positioned forward of the shear opening 66, adjacent the interior upper opening in the compactor chamber 34, and approximately at the lower portion of the feed funnel 32 (see FIG. 6*a* and 6*b*) along the transition from the compactor chamber 34 and the bailing chamber 38. The shear opening 66 is capable of accepting elongated rods, bars, connectors, and/or sized-reduced segments of elongated aluminum or non-ferrous materials, and, in conjunction with the shear bar 94, provides for shearing off of segments of the rods or bars as the piston 42 and ram head 44 move through the first end of the compactor chamber 34 and past the shear bar 94. As the piston 42 and ram head 44 are reciprocally extendable through the first end of the compactor chamber 34, additional segments of rods or bars are extended into the shear opening 66, are sheared off against shear bar 94, and segments are carried into the bailing chamber 38, for compaction into the densified shape 68 within the bailing chamber 38, by pressures of up to about thirty tons of pressure transmitted by the piston 42 and ram head 44 that are reciprocally extendable through the first end of the compactor chamber 34.

Figure 7:
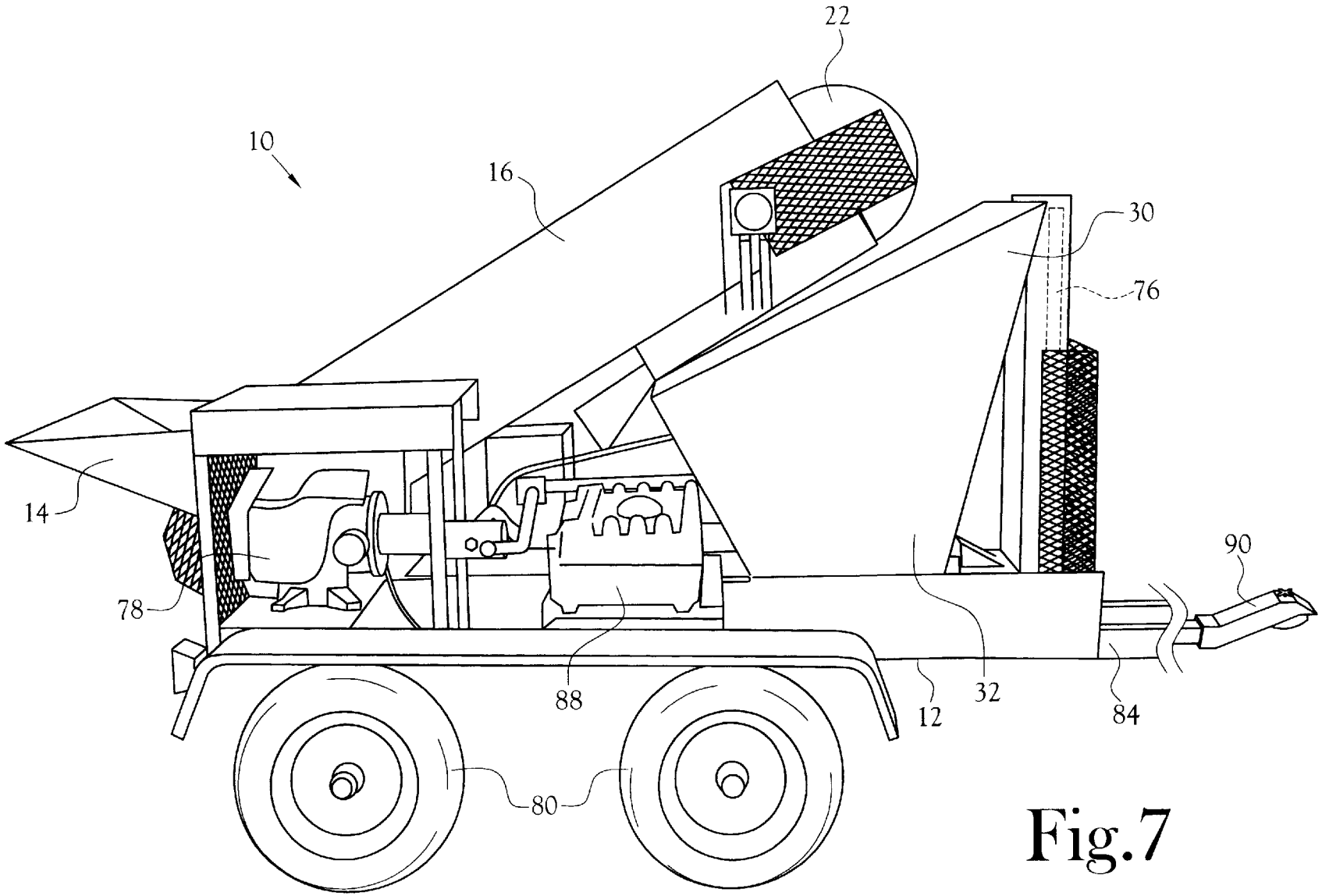
FIG. 7 is an opposite side view of FIG. 1, illustrating an engine, fuel storage reservoir, conveyor system and a hitch connector integrally mounted on the transportable frame.

From the foregoing description, it is recognized by those skilled in the art that the transportable compactor 10 provides an advantage due to the combination of the compactor chamber 34 and the bailing chamber 38 that is movable at elevated speeds over public and private roads to a multitude of locations. At each location, the transported compactor chamber 34, bailing chamber 38, and the repetitive compressing action of the piston end 36 and ram head 44, compacts large volumes of recyclable materials into a plurality of densified shape 68 of recyclable materials. Each densified shape 68 retains its shape after discharge from the bailing chamber 38 without additional bindings or wrappings due to the pressures exerted by the piston end 36 and the indentations made by ram head 44 on the densified shape 68. Further, the compacting chamber includes a shear opening 66 that provides for shearing of segments of elongated recyclable materials as the piston end 36 and ram head 44 move through the first end of compactor chamber 34. The compacted shapes, whether containing compacted elongated shapes or compacted containers of recyclable materials, are generated in sizes of about eight inches by eight inches by about eight inches, of about eight pounds weight, therefore providing an efficiently stored and transported self-supporting densified shape 68 for storage or delivery to a recycling operation. An additional advantage of the transportable compactor 10 includes the ability to connect the frame 12 having a trailer hitch 90 (see FIG. 7) to a transport vehicle for transport along public or private roads to any of a multitude of locations where recyclable materials are generated as scrap metal, or are stored for potential compaction and transport to recycling facilities. At each location, the at least two pair of wheels 80 support the main weight of the frame 12 and integrally mounted equipment on the frame 12, with a retractable wheel 92 (see FIG. 1) being extended to an upright position for support of the trough 84 and frame 12 in a generally horizontal position during operation of the transportable compactor 10.

A method of separating ferrous materials from non-ferrous materials and compacting recyclable materials is disclosed, including the steps of providing a transportable trailer frame integrally supporting a conveying system for conveying non-ferrous materials and ferrous materials to a discharging position above the frame. A separating step includes separating the non-ferrous materials from the ferrous materials at the discharging position. After the separating step, the non-ferrous materials are channeled into a compactor chamber having a reciprocally extendable piston end controlled by the operator.

A compacting step includes repetitively compacting and densifying recyclable materials with the reciprocally extendable piston, forming the non-ferrous materials into a self-supporting densified shape in a bailing chamber in a second end of the compactor chamber. After the compressing step, the self-supporting densified shape is ejected from the compactor chamber by pushing with the reciprocally extendable piston through the second end of the chamber. The ejecting step further includes the steps of extending the reciprocally extendable piston through the second chamber while opening a keeper gate forming a wall of the second chamber, thereby ejecting the self-supporting densified shape from the compactor chamber. The self-supporting compacted shape is retained outside the second chamber after the ejecting step by a retention flap pivotably attached on the outer top side of the movable end wall of the second end of the compactor chamber.

The method of operating the transportable compactor for separating and compacting non-ferrous materials generates self-supporting densified shapes of recyclable materials that retain their shapes without additional binders or supports being placed on the compacted shapes. The method of separating and compacting is repeatable at various locations by attaching a trailer hitch mounted on the transportable frame, or similar connector on the frame, to a transport vehicle, and transporting the transportable compactor to another location for separating, compacting, and generating densified shapes for storage and/or deliver to a recycling operation.

While a preferred embodiment for the foregoing is shown and described, it is understood that the description is not intended to limit the disclosures, but rather is intended to cover all apparatus modifications and alternate methods of operation falling within the spirit and the scope of the invention as defined in the appended claims.

I claim:

1. A transportable compactor apparatus for separation of recyclable materials from non-recyclable materials and for compaction of recyclable materials, comprising:

a trailer including a frame having a first end and an opposed second end, said frame having a hitch connector mounted on said second end of said trailer, said frame including a plurality of wheels rotatably mounted to said frame between said first end and said second end of said frame, said plurality of wheels disposed to support said frame for transport of said trailer along public and private roads upon connection of said hitch connector to a transport vehicle;

a conveyor mounted on said frame, said conveyor transports recyclable materials and non-recyclable materials from said first end of said frame to a discharge end of said conveyor;

separator mounted on said frame at said discharge end of said conveyor, the recyclable materials directed by said separator into a channel positioned proximate said separator, with the non-recyclable materials discharged to a discharge chute positioned under said separator;

a compactor chamber mounted on said frame, said compactor chamber including a first end, a second end opposed from said first end, and an upper opening proximate said first end of said compactor chamber, said upper opening connected to said channel, said upper opening receives a volume of recyclable materials from said channel, said second end of said compactor chamber having an opening and a movable end wall positioned across said opening in said second end of said compactor chamber; and a piston having a first end connectable to said frame, and having a compactor end reciprocally extendable through said first end and said second end of said compactor chamber, said compactor end including a raised pattern extended from said compactor end of said piston, said raised pattern being repetitively contacted against said volume of recyclable materials by said compactor end reciprocally extendable against said volume of recyclable materials in said compactor chamber to compact said volume of recyclable materials into a densified shape in said second end against said movable end wall of said compactor chamber, whereby said raised pattern interlocks said recyclable materials into a self-supporting densified shape.

2. The transportable compactor apparatus of claim 1, wherein said movable end wall including a keeper gate positionable in either an open configuration proximate said open end or in a closed configuration in said second end, said densified shape being compressed against said keeper gate by said compactor end when said keeper gate is positioned in said closed configuration, said densified shape extended through and past said keeper gate by said compactor end when said keeper gate is positioned in said open configuration.

3. The transportable compactor apparatus of claim 2, wherein said compactor chamber second end further including a retention flap being pivotably attached on an outer side of said second end of said compactor chamber, said retention flap pivotably extended downwards across said outer side of said second end when said keeper gate is in said closed configuration, said densified shape being extended under said retention flap by said compactor end reciprocally extended through said second end when said keeper gate is in said open configuration, said densified shape being retained outside said second end by said retention flap pivoted against said densified shape when said compactor end is withdrawn into said second end of said compactor chamber.

4. The transportable compactor apparatus of claim 3, wherein said frame further includes a trough mounted on said frame, said trough extended from said movable end wall of said second end of said compactor chamber, said densified shape being ejected from said second end of said compactor chamber and onto said trough by extension of said compactor end through said second end when said keeper gate is in said open configuration, said densified shape being retained in said trough outside said second end by said retention flap pivoted against said densified shape.

5. The transportable compactor apparatus of claim 1, wherein said frame including at least two pair of wheels rotatably mounted to said frame for support in a generally horizontal position above a supporting surface and for transport of said frame, said frame including a single wheel pivotably attachable to said trough, said single wheel pivoted to a substantially vertical position for support of said frame in the generally horizontal position when said trailer is positioned for compaction of recyclable materials, said single wheel pivoted to a substantially horizontal position along said trough when said trailer is connected by said hitch connector to the transport vehicle for transport along public and private roads.

6. The transportable compactor apparatus of claim 1, wherein said first end of said trailer including a receiving hopper mounted on said frame for placement of non-recyclable and recyclable materials having ferrous and non-ferrous materials in said receiving hopper, said receiving hopper positioned to direct the materials onto said conveyor for transport to said discharge end of said conveyor.

7. The transportable compactor apparatus of claim 6, wherein said conveyor including a rotatable slave cylinder mounted at said frame first end, a rotatable drive cylinder mounted at said discharge end, and a continuous belt suspended therebetween, said continuous belt being movable between said rotatable slave cylinder and said rotatable drive cylinder, said rotatable drive cylinder being rotated by an engine mounted on said frame of said trailer.

8. The transportable compactor apparatus of claim 7, wherein said separator including said rotatable drive cylinder being magnetized for retention of ferrous materials against said movable continuous belt supported by said rotatable drive cylinder, said continuous belt being moved around said rotatable drive cylinder for discharge of non-ferrous materials from said continuous belt into said channel, with ferrous materials retained against said continuous belt moved around said rotatable drive cylinder.

9. The transportable compactor apparatus of claim 8, wherein said separator including a funnel positioned under said continuous belt moved around said rotatable drive cylinder, said funnel having a bar for redirection of ferrous materials off of said continuous belt around said rotatable drive cylinder and into said funnel for collection of ferrous materials.

10. The transportable compactor apparatus of claim 1, wherein said compactor chamber including a shear opening positioned through a side wall proximate said first end of said compactor chamber, whereby a segment of elongated recyclable materials is sheared off into said first end when inserted through said shear opening as said piston having said compactor end is extended through said first end, with said sheared segment being compacted within said densified shape in said second end of said compactor chamber.

11. A transportable apparatus for separation of recyclable materials from non-recyclable materials and for compaction of recyclable materials, said apparatus being transportable along public and private roads, comprising:

a frame having a first end and an opposed second end having a hitch connector mounted at said second end, said frame having a plurality of wheels rotatably mounted thereon for support above a supporting surface and for transport of said frame along public and private roads upon connection of said hitch connector to a transport vehicle;

a conveyor mounted on said frame, said conveyor conveys recyclable and non-recyclable materials from a receiving end to a discharge end of said conveyor, said receiving end positioned at said first end of said frame, said discharge end positioned between said first end and said second end of said frame;

a separator mounted on said frame at said discharge end of said conveyor, the recyclable materials directed by said separator into a channel positioned proximate said separator, with the non-recyclable materials discharged to a discharge chute positioned under said separator;

a compactor chamber mounted on said frame and positioned below said channel, said compactor chamber having a first end, and opposed second end, and an upper opening proximate said first end for receipt of a volume of recyclable materials from said channel;

a piston reciprocally extendable into said first end of said compactor chamber, said piston having a compactor end thereon, said compactor end extendable against said volume of recyclable materials in said compactor chamber, said compactor end including a raised pattern extended from said compactor end of said piston, said raised pattern being repetitively contacted against said volume of recyclable materials, said raised pattern interlocks said recyclable materials into a self-supporting densified shape;

a bailing chamber proximal said second end of said compactor chamber, said bailing chamber receives said volume of recyclable materials when said compactor end is reciprocally extendable through said first end and into said bailing chamber, said volume of recyclable materials being compressed in said bailing chamber into said self-supporting densified shape, said bailing chamber having an open end proximal said second end of said compactor chamber;

a movable end wall positionable in either a closed configuration across said open end, or positionable in an open configuration proximate said open end, said self-supporting densified shape being further compressed by said compactor end against an inner side of said movable end wall when in said closed configuration; and a retention flap being pivotably mounted outside said second end of said compactor chamber, said self-supporting densified shape extended under said retention flap by said compactor end reciprocally extended through said second end when said movable end wall is in said open configuration, said self-supporting densified shape being retained outside said second end by said retention flap when said compactor end is withdrawn into said second end of said compactor chamber.

12. The transportable apparatus of claim 11, wherein said frame includes: p1a hydraulic system mounted on said frame for reciprocal extension of said piston and said compactor end, and for movement of said movable end wall between said open configuration and said closed configuration, said hydraulic system controlled by an operator for reciprocal extension of said piston and said compactor end, and for repetitive movement of said movable end wall between said closed and said open configurations, for ejection of said self-supporting densified shape from said second end by extension of said piston and said compactor end when said movable end wall is in said open configuration, and p1a trough mounted to said second end of said frame, said trough extended from said movable end wall of said second end of said compactor chamber to said hitch connector of said second end of said frame, said self-supporting densified shape being ejected from said second end of said compactor chamber and onto said trough by extension of said compactor end through said second end of said compactor chamber when said movable end wall is in said open configuration, said self-supporting densified shape being retained in said trough.

13. The transportable apparatus of claim 12, wherein said frame including at least two pair of wheels rotatably mounted to said frame for support in a generally horizontal position above a supporting surface and for transport of said frame, said frame including a single wheel pivotably attachable to said trough, said single wheel pivoted to a substantially vertical position for support of said frame in the generally horizontal position when said frame is positioned for compaction of recyclable materials, said single wheel pivoted to a substantially horizontal position along said trough when said frame is connected by said hitch connector to the transport vehicle for transport along public and private roads.

14. The transportable apparatus of claim 11, wherein said first end of said frame including a receiving hopper mounted on said first end for placement of non-recyclable and recyclable materials having ferrous and non-ferrous materials in said receiving hopper, said receiving hopper positioned to direct the materials onto said conveyor for transport to said discharge end of said conveyor.

15. The transportable apparatus of claim 11, wherein said conveyor including a rotatable slave cylinder mounted at said frame first end, a rotatable drive cylinder mounted at said discharge end, and a continuous belt suspended therebetween, said continuous belt being movable between said rotatable slave cylinder and said rotatable drive cylinder, said rotatable drive cylinder being rotated by an engine mounted on said frame of said trailer.

16. The transportable apparatus of claim 15, wherein said rotatable drive cylinder being magnetized for retention of ferrous materials against said movable continuous belt supported by said rotatable drive cylinder, said continuous belt being moved around said rotatable drive cylinder for discharge of non-ferrous materials from said continuous belt into said channel, with the ferrous materials retained against said continuous belt moved around said rotatable drive cylinder.

17. The transportable apparatus of claim 16, wherein said separator including a funnel under said movable continuous belt driven around said rotatable drive cylinder, said funnel having a bar for redirection of the ferrous materials off of said movable continuous belt and into said funnel for collection of the ferrous materials.

18. The transportable apparatus of claim 11, wherein said compactor chamber including a shear opening positioned through a side wall proximate said first end of said compactor chamber, whereby a segment of elongated recyclable materials is sheared off into said first end when inserted through said shear opening as said piston having said compactor end is extended through said first end of said compactor chamber, with said sheared segment being compacted within said self-supporting densified shape in said bailing chamber of said second end of said compactor chamber.

19. A transportable compactor apparatus for separation of recyclable materials from non-recyclable materials and for compaction of recyclable materials, comprising: p1a trailer including a frame having a hitch connector mounted on an end of said trailer, said frame including a plurality of wheels rotatably mounted to said frame; p1a conveyor mounted on said frame, said conveyor includes a conveyor belt for conveyance of recyclable and non-recyclable materials from a receiving end to a discharge end of said conveyor belt; p1a separator mounted on said frame at said discharge end of said conveyor belt, the recyclable materials directed by said separator into a channel positioned proximal said separator, with the non-recyclable materials discharged to a discharge chute positioned adjacent said separator; p1a compactor chamber mounted on said frame and positioned below said channel, said compactor chamber having a first end, and opposed second end, and an upper opening proximate said first end for receipt of a volume of recyclable materials from said channel; p1a piston reciprocally extendable into said first end of said compactor chamber, said piston having a compactor end thereon, said compactor end extendable against said volume of recyclable materials in said compactor chamber, said compactor end including a raised pattern extended from said compactor end, said raised pattern being repetitively contacted against said volume of recyclable materials; p1a bailing chamber proximal said second end of said compactor chamber, said bailing chamber receives said volume of recyclable materials when said compactor end is reciprocally extendable through said first end and into said bailing chamber, said volume of recyclable materials being compressed in said bailing chamber, said raised pattern extended from said compactor end interlocks said volume of recyclable materials into a self-supporting densified shape within said bailing chamber, said bailing chamber having an open end proximal said second end of said compactor chamber; p1a movable end wall positionable in either a closed configuration across said open end, or positionable in an open configuration proximate said open end, said self-supporting densified shape being compressed by said compactor end against an inner side of said movable end wall when in said closed configuration, said densified shape being moved out of said bailing chamber when said movable end wall is positioned in said open configuration; p1a retention flap being pivotably mounted outside said second end of said compactor chamber, said self-supporting densified shape extended under said retention flap by said compactor end reciprocally extended through said second end when said movable end wall is in said open configuration, said self-supporting densified shape being retained outside said second end by said retention flap when said compactor end is withdrawn into said second end of said compactor chamber; and p1a trough mounted to extend from said movable end wall of said second end of said compactor chamber to said second end of said frame, said self-supporting densified shape being ejected from said second end of said compactor chamber and onto said trough by extension of said compactor end through said second end of said compactor chamber when said movable end wall is in said open configuration, said self-supporting densified shape being retained in said trough.

20. The transportable compactor apparatus of claim 19 wherein said raised pattern includes a star shaped pattern having edges sloped toward said compactor end, said star shaped pattern interlocks said volume of recyclable materials into said self-supporting densified shape.

* * * * *